US005129715A

United States Patent [19]

Maynard, Jr.

[11] Patent Number: 5,129,715

[45] Date of Patent: Jul. 14, 1992

[54] PORTABLE DESK WITH BIFOLDING SUPPORTS

[76] Inventor: Stuart T. Maynard, Jr., 12 Lookout Rd., Asheville, N.C. 28805

[21] Appl. No.: 580,099

[22] Filed: Sep. 11, 1990

Related U.S. Application Data

[63] Continuation-in-part of Ser. No. 264,838, Oct. 31, 1988, Pat. No. 4,969,698.

[51] Int. Cl.[5] ..... A47B 88/00

[52] U.S. Cl. ..... 312/351.9; 248/439; 248/463

[58] Field of Search ..... 108/43, 132; 248/463, 248/439; 312/324, 325, 254, 255, 194, 195

[56] References Cited

U.S. PATENT DOCUMENTS

| | | | |
|---|---|---|---|
| 1,138,156 | 5/1915 | Stroud | 108/131 |
| 3,147,052 | 9/1964 | Carr | 312/241 |
| 3,147,949 | 9/1964 | Webster | 248/463 |
| 3,652,051 | 3/1972 | McFarlane | 248/463 |
| 3,695,567 | 10/1972 | Weagle | 108/132 X |
| 3,701,576 | 10/1972 | Moen | 312/231 |
| 3,730,077 | 5/1973 | Selden | 108/43 |
| 3,821,936 | 7/1974 | Moorse | 108/43 |
| 4,052,944 | 11/1977 | Jennings | 108/43 |
| 4,106,413 | 4/1978 | Hoaglund | 248/439 |
| 4,467,991 | 8/1984 | Bailes | 248/447.1 |
| 4,953,473 | 9/1990 | Tomaka et al. | 108/132 |
| 4,969,698 | 11/1990 | Maynard, Jr. | 312/255 X |

*Primary Examiner*—Joseph Falk

[57] ABSTRACT

A portable desk with a work surface panel supported between two support compartments which are hinged. Each support compartment not only is foldable from a right angle position of support to a parallel storage folded inward and beneath the work surface panel, but also is foldable from the right angle support position outward and parallel to the work surface panel. An interposed hingeable piece allows the combined support compartments and panel to bifold outward and bridge the space between two surfaces such as the arms of an armchair or bedrails.

7 Claims, 4 Drawing Sheets

PORTABLE DESK WITH BIFOLDING SUPPORTS

This is a continuation-in-part of copending application Ser. No. 07/264,838, now U.S. Pat. No. 4,969,698, filed on Oct. 31, 1988.

FIELD OF THE INVENTION

This invention relates to providing support of reading and writing materials for a person seated on a couch, chair, bench, or bedside to a position above the user's lap inclined away from the user.

This is an improvement of my previous application Ser. No. 07/264,838, filed on Oct. 31, 1988. The improvement is applicable to supporting a folding portable desk upon two arms of an arm chair.

BACKGROUND AND DESCRIPTION OF PRIOR ART

Support of materials above the user's lap provides freedom of movement for the lower body compared to lap boards which must be placed upon the lap. Support of the user's arms, as well as materials and the hands, gives added relief to shoulder muscular tension. Elevation also beings materials to an appropriate visual range thus decreasing downward flexion of the neck. U.S. Pat. No. 3,147,949 discloses a lapboard that is somewhat elevated and inclined rather greatly while being supported on the lap. U.S. Pat. No. 3,730,077 discloses a collapsible lapboard that elevates a clipboard above the user's lap, taking on some of the character of a desk surface. Another lap desk supported directly on the lap is disclosed by Jennings, in U.S. Pat. No. 4,052,944.

Supports can also hold the work surface above the user's body and allow free movement of leg positions as in the case of bedtrays. As disclosed in detail in parent application Ser. No. 07/264,838, supports are employed which extend to the seat surface upon which the user is seated, or the portable desk may be placed on a table where it achieves a total height suitable for a standing work site or a speakers stand. A seated user of this desk is allowed some freedom of movement since the desk is not supported directly on the lap.

Alternative sites on which to support a desk unit above the lap of a seated user are the arms of a chair rather than the seat surface of a chair. Such sites of support to the arms of a chair is shown in U.S. Pat. No. 4,467,991, which has extensions of the desk frame aligned with the arms.

OBJECTS OF THE INVENTION

It is an object of this embodiment of a portable desk to enable support on the arms of an armchair, as well as support on a seat surface of a chair or sofa which lacks arms, and also to provide for compact folding into storage.

SUMMARY OF THE INVENTION

The previous disclosure in the parent application of the portable desk accomplishes two positions for supports. 1. Extended, upright support compartments may reach generally the same seat surface which supports the user; and 2., support compartments folded toward the underside of a work surface panel results in a compact form for storage.

In another embodiment as shown herein, the portable desk can be improved to accomplish support on the arms of an armchair, by providing for the folding of the support compartments outwardly so as to reach the arm surfaces to each side of a chair. This is accomplished by the employment of an additional hingeable member at each support compartment. In combination, the two hingeable members provide for bi-directional folding from: folded into storage (underneath the work surface), through upright extension to the seat surface (generally 90 degrees), to outward extension to engage the arm surfaces of a chair (180 degrees).

In a bifold configuration, there are commonly two axes of pivot joining three pieces, which may be three panels such as doors or walls, or simply three leaves of a (bifolding) hinge. In this invention, three hinged pieces are: A one side of a support compartment, B. an intermediary hingeable member, and C. a work surface panel or a simple crosspiece which is fixed to the underside of such a work surface panel.

BRIEF DESCRIPTION OF THE DRAWINGS

FIG. 3 A shows inward folded support compartment

FIG. 3 B shows support compartment 90 degree extended

FIG. 3 C shows support compartment extended 180 degree outward.

DESCRIPTION OF THE DRAWINGS AND THE PREFERRED EMBODIMENT

Figure 1:
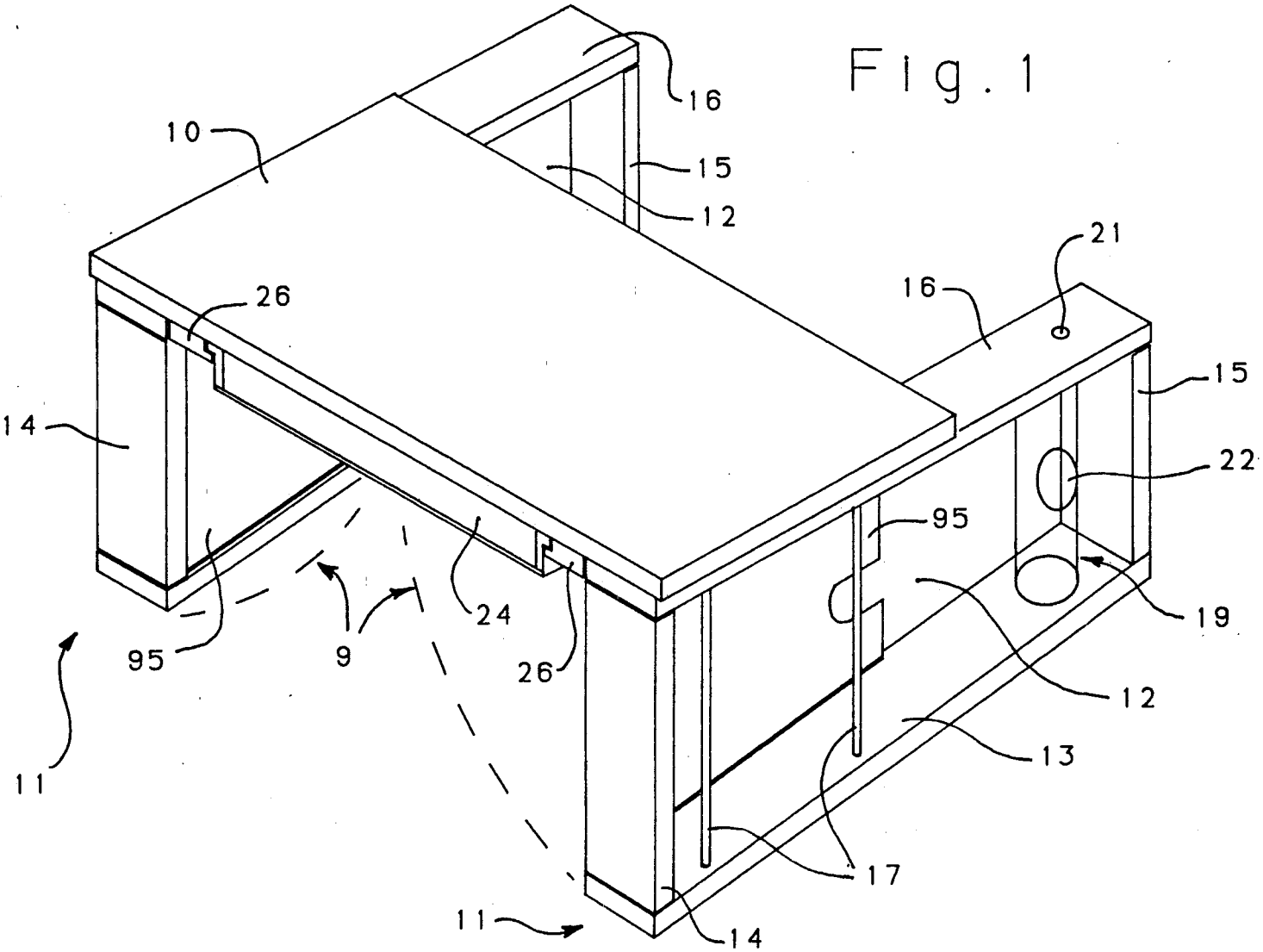
FIG. 1 is a perspective view of the portable desk showing essential elements as disclosed in the parent application. This configuration is capable of folding between the two functional positions as cited above.

Referring to FIG. 1, the preferred embodiment of the parent application is shown as a portable desk standing on extended supports in perspective view.

A work surface panel 10 is sustained on support compartments 11 which are paired and shown extended. Each support compartment 11 forms a quadrangle enclosure 12 consisting of a base member 13, front upright member 14, rear upright member 15, and hingeable member 16. Barrier side rails 17 allow for the alignment of an object such as a book, such that it will not fall from the enclosure 12 unless it is manually rotated at an angle to the plane of enclosure 12. Hingeable member 16 extends rearwardly of the work surface panel 10 and acts as an arm or elbow rest for the user.

Pencil holder 19 which is a tube that is cylindrical in this embodiment and is held between base member 13 and hingeable member 16 to contain pens and pencils which can be accessed through passage hole 21 provided in hingeable member 16 by finger manipulation by using finger opening 22.

A drawer front face 24 is shown in the perspective view, the drawer of which is carried beneath work surface panel 10 by cross-pieces 26.

From the drawing and description of elements of FIG. 1, it can be seen that this embodiment of the parent application, allows for folding motion of support compartments 11 between two positions cited in the invention summary which are: 1. extended upright and supporting the worksurface panel, and 2. folded inward and beneath the work surface panel for storage. In the embodiment depicted in FIG. 1, the arcs of folding of the support compartments 11 is shown at 9. In this embodiment, the hingeable member 16 of each compartment is hinged to the corresponding cross-piece 26.

The embodiment of the parent application does not provide means for bifolding, outward hinging of the support compartments in relation to the work surface panel 10.

In this perspective view it should be noted that the quadrangular space 12 is entirely enclosed on 4 sides by a perimeter of members (13, 14, 15, and 16) and it is partially enclosed on two sides as is the case of the parent embodiment. In the parent embodiment, barrier side rails 17 were provided for the partial enclosure of two sides of each quadrangular support compartment, but in this perspective view, it is instructive to show a partial panel 95 for partial enclosure at one side of the quadrangle, and barrier side rails 17 providing partial enclosure at the other side of the quadrangle.

The partial panel 95 is shown further in following FIGS. and is preferred over rails in the region of each support compartment which generally contacts the arm of an armchair during outward folding support.

Figure 2:
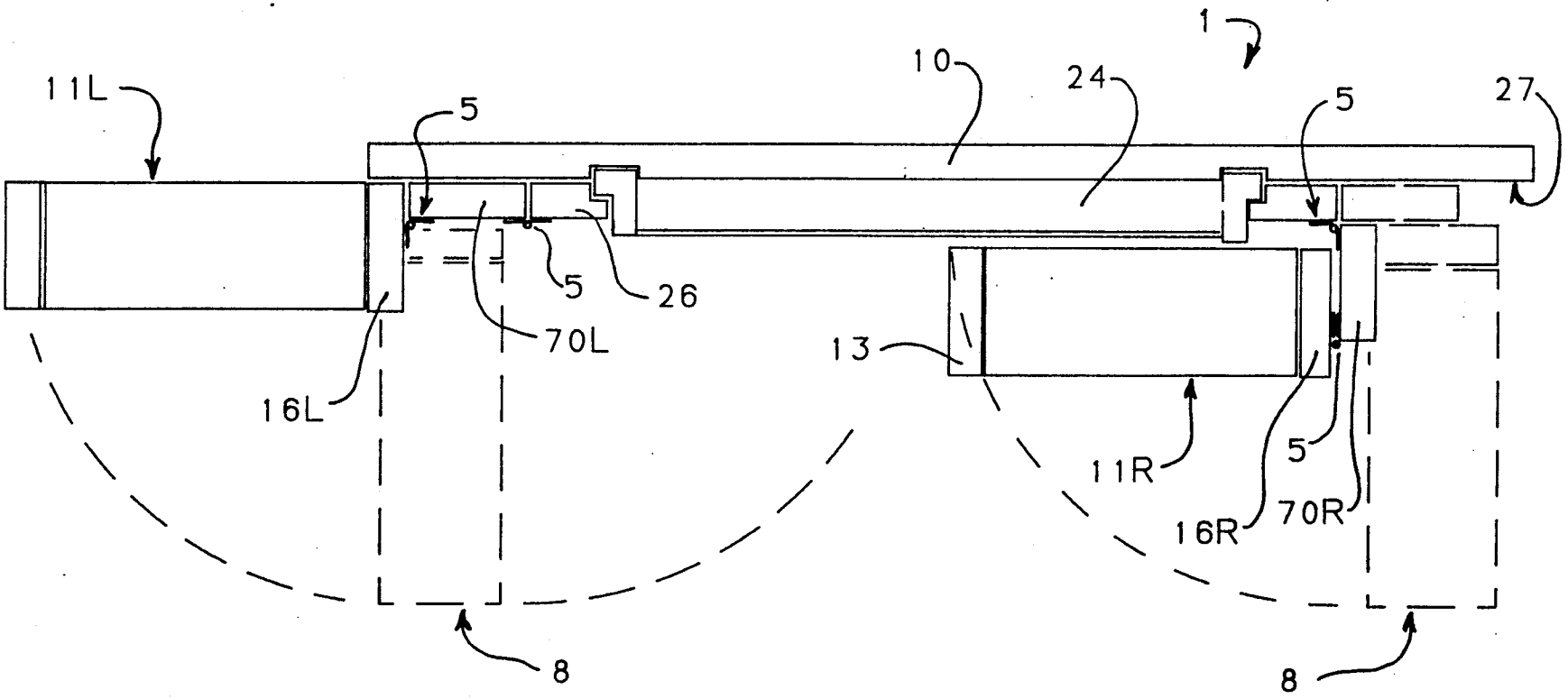
FIG. 2 is a frontal view of the improved version of the portable desk depicting the left compartment folded outward and the right compartment folded inward and under, for storage.

FIG. 2 shows the frontal view of the portable view of the portable desk which is that aspect of the desk away from the user; certain paired parts are labeled L and R for leftward and rightward orientation in the view of the onlooker (which is opposite the user).

When extended upright to positions 8, a pair of support compartments 11L and 11R support a work surface panel 10, to which a drawer 24 may also be attached between crosspieces 26.

The left support compartment 11 L is shown folded outward until it hingeable member 16L impinges on the underside of the work surface panel 10. The hingeable member 16L is hinged to the left sided upper hingeable member, 70L which remained flush to the underside of the work surface panel 10. Upper hingeable member 70L is in turn hinged to crosspiece 26.

On the right side, the support compartment 11R is shown folded into storage, parallel with the underside of drawer 24, by the action of both hingeable members 16R and upper hingeable member 70R rotating away from the underside of work surface panel 27, as a joined pair. The provision of three pieces (16, 70, and 26) joined along two axes of hinges 5 allow for the folding which is bi-directional from positions 8.

Figure 3A:
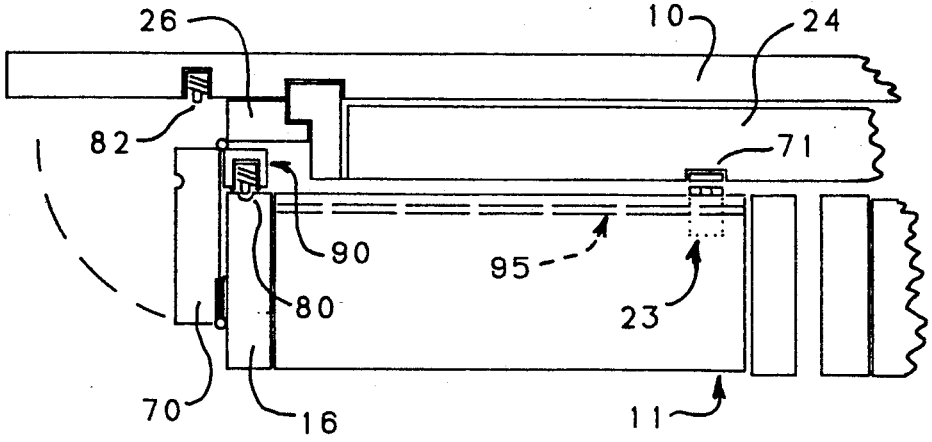
FIGS. 3A, 3B, and 3C show detailed frontal views of 3 positions of a support compartment, including suitable location for spring pin catches that selectively stabilize the specific hinged positions.
Figure 3B:
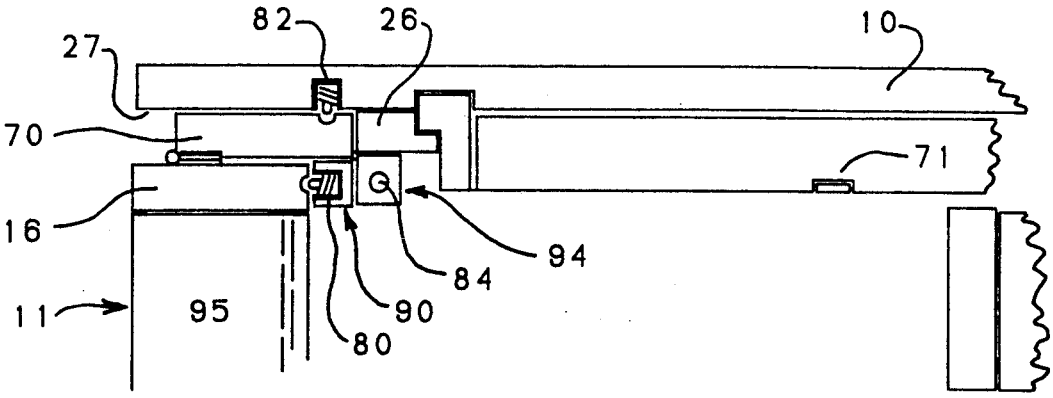
Figure 3C:
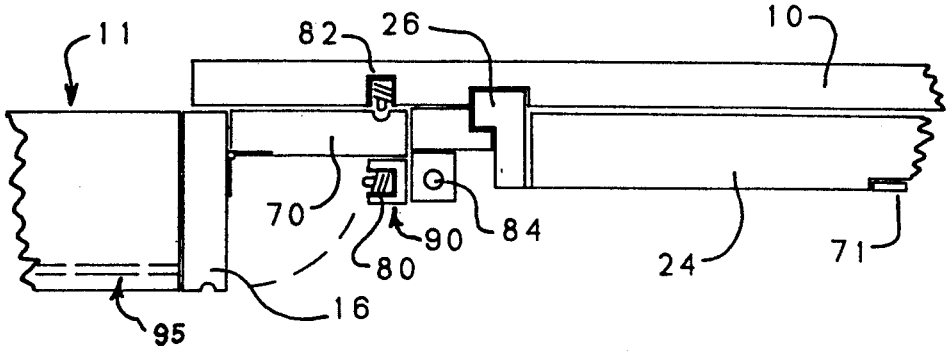

FIGS. 3A, 3B, and 3C show detail of the various hinged positions of a support compartment and locations for spring pin catches. A spring pin may be commonly known as a bullet catch; the pin or "bullet" engages a depression in a strike plate.

Each Figure is a frontal view in which those spring pins oriented perpendicular to the axis of the orthogonal view are shown in schematic cross-section regardless of the depth of cross-section from the viewer.

At least two configurations can be used to "catch", depending on the manner of approach of a strike plate to its respective spring catch.

A parallel wipe catch means that the strike plate and spring pin remain in two respective parallel planes during their relative approaches to each other.

An arc wipe catch means that the plane of the strike plate rotates through progressively more acute angles of an arc (tangent) angle approaching 0 degrees. At final approach to its respective spring pin, it is effectively parallel at the position that the pin wipes into the depression of the strike plate. Relatively speaking either the spring pin or the strike plate may be viewed as the stationary reference and the other becomes the converging arc.

FIG. 3A shows a support compartment 11 folded into storage position, in which case hingeable member 16 and upper hingeable member 70 are latched by spring pin catch 80, in mounting block 90, which is attached to upper hingeable member 70. Pin catch 80 has a arc-angle wipe action with its strike plate.

Upper hingeable member 70 is shown released from pin catch 82 which is also an arc wipe type of action. Pin catch 82 is mounted in the underside of worksurface panel 10.

By providing a mounting block for a spring pin in other orientations, it is possible to provide a parallel action catch in place of an arc angle type of action, if such is preferred. Also magnet catches may be provided to augment the action of spring pin catches or spring loaded hinges, in order to sustain a given position of the hinged parts which are described. As disclosed in the parent application Ser. No. 07/264,838), the folded storage configuration depicted in FIG. 3A may be stabilized by magnet catch 23 attracting to the underside of drawer 30 which provides a strike plate 71.

In the storage position depicted in FIG. 3A, support 11 (folded under the work surface panel 10), may be stabilized additionally by a spring pin catch 84 which may be provided having a parallel wipe action. An appropriate location for such a catch 84 is superimposed and hidden by spring pin 80, but is revealed in FIG. 3B and FIG. 4 which follow.

FIG. 3B shows a support compartment 11 extended for seat surface support, in which case the spring pin catch 84 (described as hidden in FIG. 3A) comes into view, mounted in a block 94 fixed to crosspiece 26. Spring pin 80 remains latched and upper hingeable member 70 is shown engaged with the underside 27 of work surface panel 10 and held by spring pin 82.

FIG. 3C shows support compartment 11 extended outward and its hingeable member 16 is shown released at spring pin 80. Although spring pin 82 remains latched, the main factor forcing the upper hingeable member 70 against work panel 10 is the upward torsion of support compartment 11 as it rests on a surface such as the arm of a chair. This is the case when the desk with its supports unfolded outward forms a complete bridge between two arms of an armchair. In this outward position, partial panel 95 is oriented downward where it may contact an arm surface.

Figure 4:
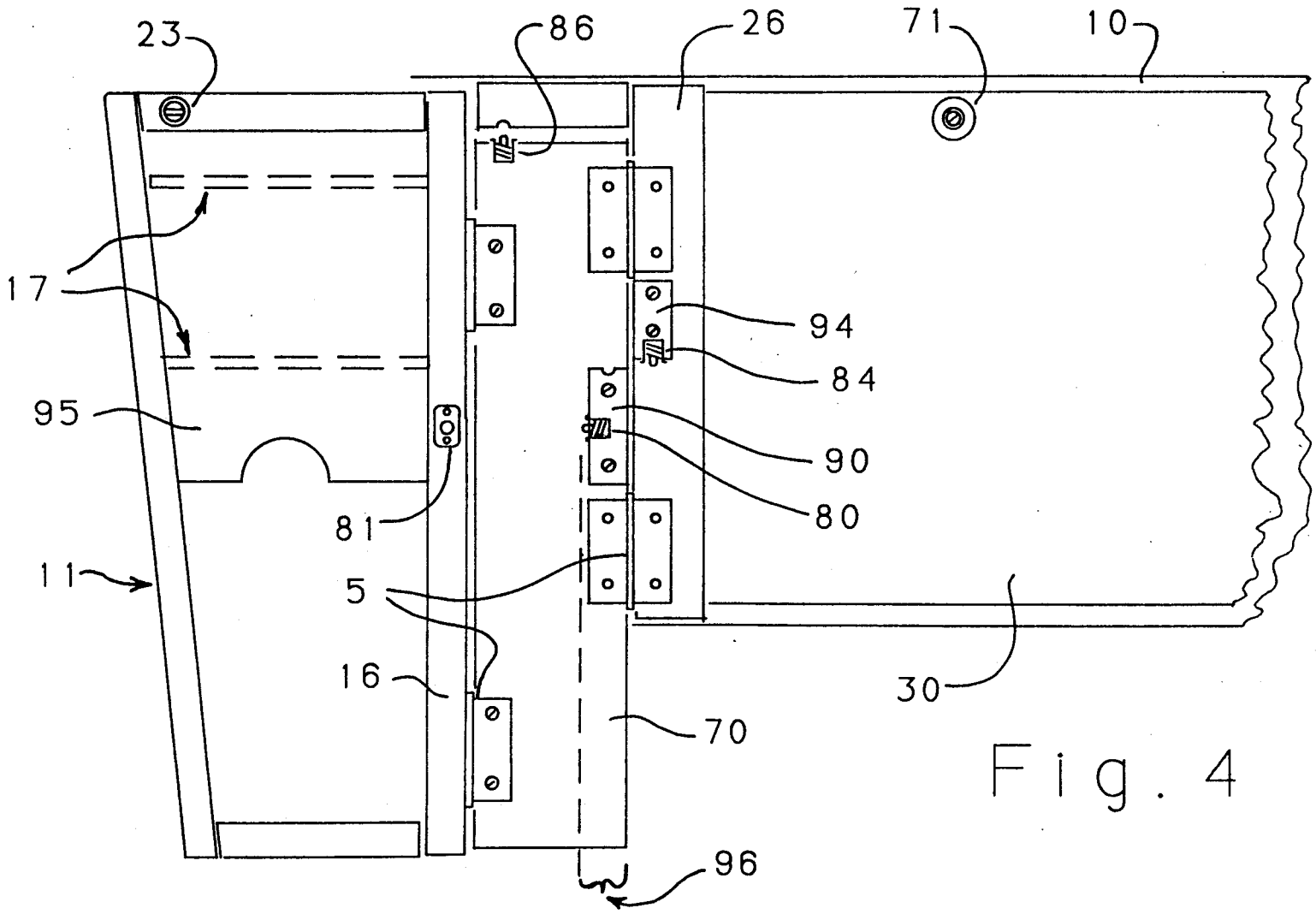
FIG. 4 is an underside view of a portable desk with an outward extended support compartment, showing hinges of upper and lower hingeable members and suitable locations for spring pin catches.

FIG. 4 shows the underside of the portable desk with support compartment 11 extended outward. Spring pin 86 shows an alternative location for stabilizing upper hingeable member 70 to the work surface panel 10 by a parallel wipe action (this could substitute for the arc wipe type of spring pin 82 as described in FIGS. 3A, 3B, 3C). Spring pin 80, with arc wipe action, is shown fixed to upper hingeable member 70, and the same mounting block 90 also may carry the strike plate for spring pin 84, a parallel wipe action which s mounted on mounting block 94, which is fixed to crosspiece 26.

The underside view shows further the element cited in Figures above including: the underside of drawer 30, magnet 23 and its catch 71 which is a means of retaining a compartment in the position of folded-under storage.

The two axes of hinges 5 which join hingeable piece 16, upper hingeable piece 70, and cross piece 26 in a bifolding relation ship are also shown. In considering this bifolding, it can be appreciated, that two hingeable pieces may be combined directly with the worksurface panel 10 to accomplish bifolding, if crosspieces and a drawer are not preferred underneath the work surface panel.

The offset distance of two hingeable members (16 and 70) is demonstrated by 96 FIG. 4 (and is also evident in frontal view Figures). By reviewing the frontal view figures, it can be noted that this distance of offset accommodates additional height for the drawer 30 when support compartment 11 is folded parallel to the underside of the drawer. This offset also allows the hingeable member 16 to impinge on upper hingeable member 70 at 90 degrees when folded outward to span between the arms of an arm chair.

As disclosed in application Ser. No. 07/264,838, a support compartment defines a quadrangular spaced in which books or pads may be retained by the addition of barrier side rails which align a book or pad within the quadrangular space. In addition to thin side rails such as dowels depicted in the parent application, a partial panel may be substituted for dowels on at least one side of a support compartment, so that a pocket is formed in a portion of the quadrangular support compartment. FIG. 4 (an underside view) shows a support compartment 11 extended outward, in which case a panel 95 is preferred as a partial barrier to retain an object such as a book within the storage compartment. This panel 95 offers a broad surface which may contact a furniture arm which may be upholstered. On the upper aspect of support compartment 11 retainer rails 17 (shown in dotted line) are preferred to allow visual as well as manual access into the compartment.

From the FIGS. 3A, 3B, 3C, and 4, it can be seen that various positions of pins and strike plates may be located having at lest two kinds of wipe action. In either case, the spring pin and it's respective strike plate can be swapped depending on esthetic choices or material thicknesses available for their mounting. In addition to the mounting blocks provided, the upper hingeable member 70 and other members of a desk frame such as the worksurface panel 10 may provide a matrix and variously oriented surfaces for the mounting of either spring pin units (such as 86), corresponding strike plates, or mounting blocks.

Bifold hinging configuration of support compartments for a portable desk allows for two positions of use an done position of compact folding as described above. Although a bifolding hinge can allow such a range of motion for a given support compartment, its middle leaf would have to equal the spatial thickness of the support compartment which is to be bifolded. The provision of an interposed hingeable piece (70) brings an added value of matrix for the mounting of catches for stabilizing chosen positions of a support. Some of the diverse positions for the mounting of at least two actions of spring pins are described and other commercially available catches may be mounted upon the hingeable pieces' or mounting blocks attached to hingeable pieces. From the description of the preferred embodiment and its principles, it can be sen that variations of this bifolding may be attained without departing from the principles disclosed here.

I claim:

1. In a portable desk having a work surface panel and supports hinged along a longitudinal hingeable surface of each said support to said work surface panel, said supports being extendable at a first position which is generally at right angles to said work surface panel and also foldable in one direction from said first position to a second position generally parallel and under said work surface panel, the improvement comprising:

a bifoldable configuration wherein a interposed hinged member is positioned between each said support and said work surface panel and said interposed hinged member has hinged attachment at a first surface to said support and at a second surface to said work surface panel, wherein each said support may be hingedly extended by rotation of said interposed hinged member in relationship to said work surface panel in a second direction from said extended first position to an outward third position which is substantially parallel to said work surface panel.

2. A portable desk as claimed in claim 1 wherein said interposed hinged member is a longitudinal board-like member hinged respectively on one of its sides to said support and at another of its sides to said work surface panel.

3. A portable desk as claimed in claim 1 wherein said support is hingedly attached to said interposed hinged member with an offset such that the outward rotation of each said support impinges each said support against said work surface panel in a generally parallel position such that the work surface panel and each said support in the outward rotated position combine to form a bridge of elements which can be carried on bearing points at each of said outward rotated supports wherein said work surface panel and objects placed upon said panel are supported in the space between bearing points which may be such sites as arms or rails of a seal or other furniture.

4. A portable desk as claimed in claim 1 including means of stabilizing said interposed hinged member in relation to said work surface panel comprising:

a spring pin catch and a matching strike plate which are mounted complimentarily on said interposed hinged member and on said work surface panel, including the mounting of either said spring pin or said strike place in the substance or a mounting block joined to the substance of the respective said interposed hinged member and said work surface panel, including wherein said spring pin and said strike plate remain in respective parallel planes during their approach to seat with one another, defining a parallel wipe action;

and including wherein said spring pin and said strike plate are related to each other during approach to seat with one another in an arc-wipe configuration, wherein either one viewed as a stationary reference at a surface location is approached by a converging and tangential arc motion of the other, defining an arc-wipe action.

5. A portable desk as claimed in claim 4 including means of stabilizing each said support in relation to said interposed hinged member comprising a spring pin catch and mating strike plate mounted complimentarily on said interposed member and said support, including said mounting in the substance of or mounting blocks attached to the substance of the respective said interposed hinged member and said support, including wherein said spring pin and said strike plate are mounted in said arc wipe configuration action or in said parallel wipe configuration.

6. In a portable desk as claimed in claim 1, having quadrangular support compartments which are partially enclosed by barrier rails on two sides to form a pocket within said support compartment and accessible through said two sides of said quadrangular supports, the improvement comprising:

the positioning of a partial panel barrier at either of said two sides of said support compartment forming said pocket in conjunction with said support compartment and defining said access opening into space of said compartment.

7. In a portable desk having foldable supports hinged to a work surface panel, the configuration of hinging of said supports which provides hinged movement of said support in a 180 degree range of movement from the position of folded generally parallel and under said work surface panel; through the position of extension at right angle to said work surface panel; to the position of outward extension parallel to said work surface panel comprising:

the elements of a work surface panel providing underside surface and a pair of supports, each support providing a substantially longitudinal surface area which is suitable for hinged attachment, and an interposed member which is substantially elongated and hinged at one of its surfaces to underside of said work surface panel and hinged at another of its surfaces to said longitudinal surface area of each support wherein said work surface panel and each said support may be held proximate to said interposed member by hinged rotation toward said interposed member or may be moved in a bifolding relationship by rotation away from said interposed member wherein 1. each of said supports is held substantially perpendicular in relation to said work surface panel when both said work surface panel ad each said support are rotated proximate to said interposed member
2. said support may be rotated to a position substantially under and parallel to said work surface panel by remaining proximate to said interposed member while said interposed member is hingedly rotated away from said work surface panel
3. said support may be rotated to a position substantially out from and parallel to said work surface panel by hinged rotation of said support away from said interposed member while said interposed member is maintained proximate with said work surface panel.

* * * * *